United States Patent [19]

Limoges et al.

[11] 4,308,342

[45] Dec. 29, 1981

[54] DIMENSIONALLY STABILIZED IMAGING ELEMENT AND METHOD

[75] Inventors: Raymond F. Limoges, Rochester; Anthony A. Scribani, Fairport; Robert J. Wilson, Webster, all of N.Y.

[73] Assignee: Eastman Kodak Company, Rochester, N.Y.

[21] Appl. No.: 202,401

[22] Filed: Oct. 31, 1980

[51] Int. Cl.[3] ..... G03C 1/52

[52] U.S. Cl. ..... 430/338; 430/340; 430/341; 430/340; 430/335; 430/939; 430/533; 430/523; 430/531; 430/936; 430/935; 426/384

[58] Field of Search ..... 430/939, 533, 341, 523, 430/335, 531, 338, 936, 340, 495, 935, 494; 427/384

[56] References Cited

U.S. PATENT DOCUMENTS

| | | | |
|---|---|---|---|
| 2,627,088 | 2/1953 | Alles et al. | 264/235 |
| 2,779,684 | 1/1957 | Alles | 430/939 |
| 3,834,928 | 9/1974 | Tatsuta et al. | 430/533 |
| 3,939,000 | 2/1976 | Arvidson et al. | 430/502 |
| 4,076,532 | 2/1978 | Gottermeier | 430/533 |
| 4,112,280 | 9/1978 | Salsich | 219/216 |
| 4,141,735 | 2/1979 | Schrader et al. | 430/533 |
| 4,255,481 | 3/1981 | Dinella et al. | 428/422 |

FOREIGN PATENT DOCUMENTS

| | | | |
|---|---|---|---|
| 52-149117 | 12/1977 | Japan | 430/502 |
| 1000361 | 8/1965 | United Kingdom . | |

OTHER PUBLICATIONS

Research Disclosure, Pub. 17935, Published Mar. 1979, in vol. 179.

Research Disclosure, Pub. 16239, Published Oct. 1977, in vol. 162.

Research Disclosure, Pub. 18436, Published Aug. 1979, in vol. 184.

*Primary Examiner*—Won H. Louie, Jr.

*Attorney, Agent, or Firm*—Dana M. Schmidt

[57] ABSTRACT

A thermally processable imaging element and method are disclosed, wherein dimensional changes after thermal processing for about 5 seconds at a temperature of about 125° C., do not exceed ±0.03%. The imaging element features an amine-generating and an amine-responsive composition. The method features preheating the element prior to exposure to dimensionally stabilize it.

5 Claims, No Drawings

DIMENSIONALLY STABILIZED IMAGING ELEMENT AND METHOD

(1) FIELD OF THE INVENTION

This invention relates to a non-silver imaging element containing an amine-generating composition, and a method for forming improved images therewith.

(2) BACKGROUND OF THE INVENTION

Non-silver imaging compositions relying upon the conversion of cobalt(III) complexes to cobalt(II) and released ligands are described in a number of publications, for example, *Research Disclosure,* Vol. 184, Publication No. 18436 dated August 1979, published by Industrial Opportunities Ltd., Homewell, Havant, Hampshire, PO9 1EF United Kingdom. In one form, e.g., Examples 8 and 9 thereof, a quinone photoreductant and o-phthalaldehyde, hereinafter "phthalaldehyde," are included, in one or more layers, with the cobalt(III) complex. Upon exposure to light, the photoreductant forms a reducing agent for the complex. Upon development by heat, the ligands of the complex are released to produce, with the phthalaldehyde, a black dye. A variation of this composition is also described in *Research Disclosure,* Publication No. 18436, Vol. 184, August, 1979, wherein photoinhibitors are added to permit light radiation to imagewise inhibit the composition from forming a dye.

Such imaging compositions have been found to be highly useful, particularly for contact positive or negative imaging, when coated on a support as an imaging element. However, the thermal development of the image frequently requires temperatures that exceed 125° C., and sometimes even 135° C. It has been found that invariably, such high temperatures cause significant dimensional changes in the afore-described imaging element. In some cases, these changes tend to interfere with proper image registration. Specifically, the high thermal development temperatures cause dimensional changes in either the width and/or length, that exceed ±0.03%. Such changes prevent accurate color registration when using color separation negatives or positives prepared from these imaging compositions.

Prior to this invention, it has been recognized that imaging elements comprising, a light-sensitive silver halide layer on a poly(ethylene terephthalate) support can be adversely affected by thermally-induced dimensional changes incurred by the support alone. Various heat-relaxing techniques have been applied to the support prior to the coating of the light-sensitive silver halide layer(s), to eliminate or reduce that aspect of the problem. Examples are described in U.S. Pat. No. 2,779,684, and British Pat. No. 1,000,361, published Aug. 4, 1965. However, even when those specially treated supports are used in the imaging elements noted above, the dimensional changes that occur upon thermal development are still unacceptable, that is, they still exceed ±0.03% in width or length.

U.S. Pat. No. 3,939,000, issued on Feb. 17, 1976, suggests that an alternative to heat-relaxing a poly(ethylene terephthalate) support alone is to heat-treat the fully-coated element prior to use, at least in those cases where the light-sensitive layer is silver halide. The purpose is to eliminate curl such as occurs during roll storage. Such a purpose differs, of course, from the concern arising from dimensional changes caused by thermal development of an image. However, to determine whether the process described in the U.S. Pat. No. 3,939,000 also reduces dimensional changes as would occur upon thermal development at 125° C. for five seconds, a silver halide element comparable to that described in the U.S. Pat. No. 3,939,000 was tested. It has been found that heating such silver halide elements in the manner indicated by Example 1 of U.S. Pat. No. 3,939,000 is not successful in reducing dimensional changes to no greater than ±0.03% in either width or length.

SUMMARY OF THE INVENTION

In accordance with one aspect of the present invention, there is advantageously featured an imaging element which, though processed for dye development at temperatures of 125° C. or higher, still permits color imaging through the use of registered color separation positives or negatives. More specifically, there is provided a photographic imaging element comprising a poly(ethylene terephthalate) support, and on the support, at least one radiation-sensitive layer comprising a radiation-responsive, amine-generating composition and an amine-responsive dye precursor, the element having as an essential property, an overall thermal-reaction hysteresis that will provide a dimensional change of no greater than ±0.03% in width or length when processed for dye development by heating for about 5 seconds at a temperature of about 125° C.

In a related feature of the invention, there is advantageously featured an improved method for dimensionally stabilizing an imaging element after it is fully coated, to permit dye development at temperatures as high as 125° C.

More specifically the method utilizes an element prepared by coating and drying the above-described layer onto a support having dimensional changes that are no greater than about ±0.1% in width and length when heated in an uncoated state for about 5 seconds at a temperature of about 125° C. Prior to exposure the element is dimensionally stabilized by heating the element to a temperature of between about 100° C. and about 140° C. for a length of time sufficient to form in the element an overall thermal-reaction hysteresis that produces dimensional changes of no greater than ±0.03% in width or length when the element is processed by heating for about 5 seconds at a temperature of about 125° C.

Other features of the invention will become apparent upon reference to the following Description of the Preferred Embodiments.

DESCRIPTION OF THE PREFERRED EMBODIMENTS

The invention is based upon the discovery that a photographic imaging element comprising, on a support, a radiation-sensitive layer of a radiation-responsive, amine-generating composition and an amine-responsive dye precursor, can be constructed to have an overall thermal-reaction hysteresis that provides dimensional changes within the ±0.03% limit noted above. The result is an imaging element that permits accurate registration of color separation negative or positives to produce a full color image.

It is believed that the dimensional changes that occur upon thermal processing result from an overall thermal-reaction hysteresis that fails to return to the dimensions that existed prior to heating. Control of this hysteresis is necessary to control the dimensional changes. For reasons that are not completely understood, the pre-heat treatment of this invention provides the necessary control, at least for this kind of imaging element. This is surprising, in light of the fact that a similar heat treatment, when applied to a silver halide imaging element of the prior art, failed to provide the same control of dimensional changes for that silver halide element.

As used herein, unless stated otherwise, "dimensional changes" refer to the changes of the imaging element in question resulting from the heating to which it is subjected during processing. The preferred embodiments are described in connection with the dimensional changes specifically resulting from heating to provide dye development. In addition, the invention is applicable to an imaging element that is thermally processed for whatever purpose. Furthermore, the specific heating conditions of the thermal processing are not crucial, and the invention is uqually applicable to elements processed under other heating conditions, e.g., 10 sec. at 125° C. or 10 sec. at 140° C. For convenience, however, a particular thermal processing condition is selected for measuring the dimensional changes hereinafter described, namely 5 sec. at 125° C. Unless stated otherwise, the dimensional changes refer to those resulting from that heat treatment, because that treatment represents a preferred thermal processing used for dye development.

The imaging element of the invention features, preferably, a support that itself has pre-selected low dimensional changes when heated, as described hereinafter, and a radiation-sensitive layer comprising a radiation-responsive source of amines and an amine-responsive dye precursor. Useful examples of such radiation-sensitive layers are given in the above-described *Research Disclosure,* the details of which are expressly incorporated herein by reference.

More specifically, preferred examples of a radiation-responsive, amine-generating composition are those that include any material capable of generating amines by reduction, such as through the use of a photoreductant. Highly preferred are cobalt(III) complexes of the type described in the aforesaid *Research Disclosure,* particularly those that are designated as "thermally stable." That is, any cobalt(III) complex containing releasable amine ligands and which is thermally stable at room temperature will function in this invention. Such complexes on occasion have been described as being "inert." See, e.g., U.S. Pat. No. 3,862,842, Columns 5 and 6. However, the ability of such complexes to remain stable, i.e., retain their original ligands when stored by themselves or in a neutral solution at room temperature until a chemically or thermally initiated reduction to cobalt(II) takes place, is so well known that the term "inert" will not be applied herein.

Such cobalt(III) complexes feature a molecule having a cobalt atom or ion surrounded by a group of atoms or other molecules which are generically referred to as ligands. The cobalt atom or ion in the center of these complexes is a Lewis acid while the ligands, herein described as amine ligands, are Lewis bases. While it is known that cobalt is capable of forming complexes in both its divalent and trivalent forms, trivalent cobalt complexes—i.e., cobalt(III) complexes—are preferably employed in the practice of this invention, since the ligands are relatively tenaciously held in these complexes, and released when the cobalt is reduced to the (II) state.

Most preferably, the cobalt(III) complexes employed in the practice of this invention are those having a coordination number of 6. Many amine ligands are useful with cobalt(III) to form a cobalt(III) complex, including, e.g., methylamine, ethylamine, ammines, and amino acids such as glycinato. As used herein, "ammine" refers to ammonia specifically, when functioning as a ligand, whereas "amine" is used to indicate the broader class noted above.

The cobalt(III) complexes useful in the practice of this invention include those that are neutral compounds entirely free of either anions or cations. As used herein, "anion" refers to a charged species which, in the commonly understood sense of the term, does not include species that are covalently bonded. Useful cobalt(III) complexes also include those having one or more cations and anions as determined by the charge neutralization rule. Useful cations are those which produce readily soluble cobalt(III) complexes, such as alkali metals and quaternary ammonium cations.

Many anions are useful, and those disclosed in the aforesaid *Research Disclosure* are particularly useful.

The following Table I is a partial list of particularly preferred cobalt(III) complexes.

TABLE I hexa-ammine cobalt(III) benzilate
hexa-ammine cobalt(III) perfluorobenzoate
hexa-ammine cobalt(III) thiocyanate
hexa-amine cobalt(III) trifluoromethane sulfonate
hexa-ammine cobalt(III) trifluoroacetate
hexa-ammine cobalt(III) heptafluorobutyrate
chloropenta-ammine cobalt(III) perchlorate
bromopenta-ammine cobalt(III) perchlorate
aquopenta-ammine cobalt(III) perchlorate
bis(methylamine) tetra-ammine cobalt(III) hexafluorophosphate
trinitrotris-ammine cobalt(III)
penta-ammine carbonate cobalt(III) perchlorate
tris(glycinato) cobalt(III)
tris(trimethylenediamine) cobalt(III) trifluoromethanesulfonate
tri(trimethylenediamine) cobalt(III) tetrafluoroborate
bis(ethylenediamine)bisazido cobalt(III) perchlorate
triethylenetetraaminedichloro cobalt(III) trifluoroacetate
aquopenta(methylamine) cobalt(III) nitrate
chloropenta(ethylamine) cobalt(III) pentafluorobutanoate
trinitrotris(methylamine) cobalt(III)
tris(ethylenediamine) cobalt(III) trifluoroacetate
bis(dimethylglyoxime)bispyridine cobalt(III) trichloroacetate
$\mu$-superoxodecamine cobalt(III) perchlorate
trans-bis(ethylenediamine)chlorothiocyanato cobalt(III) perchlorate
trans-bis(ethylenediamine)bisazido cobalt(III) thiocyanate
cis-bis(ethylenediamine)ammineazido cobalt(III) trifluoroacetate
tris(ethylenediamine) cobalt(III) benzilate
trans-bis(ethylenediamine)dichloro cobalt(III) perchlorate
bis(ethylenediamine)dithiocyanato cobalt(III) perfluorobenzoate
triethylenetetraaminedinitro cobalt(III) dichloroacetate
tris(ethylenediamine) cobalt(III) succinate
tris(2,2,2'-bipyridyl) cobalt(III) perchlorate bis(dimethylglyoxime)chloropyridine cobalt(III) and bis(dimethylglyoxime)thiocyanatopyridine cobalt(III).

If the activating energy used to initiate the reaction is electromagnetic energy with wavelengths longer than 300 nm, e.g., light, then the material that generates the amines preferably includes a photoreductant responsive to that energy. Any photoreductant capable of forming a reducing agent for the amine-generating complex, in response to exposure to such activating electromagnetic energy, is useful. The development of the image that is initiated by such exposure preferably occurs by subsequently heating the composition to obtain a more prompt generation of the amines. A variety of useful photoreductants are disclosed, for example, in *Research Disclosure,* Vol. 126, Publication 12617, October, 1974, and U.S. Pat. No. 4,201,588 issued May 6, 1980. The details of both of these documents are expressly incorporated herein by reference. A "photoreductant" is distinguishable from other photoactivators such as spectral sensitizers in that only a photoreductant is responsive to the activating energy even in the absence of a cobalt(III) complex. Thus, the photoreductant itself is exposable, when used in a first layer without the complex, and a second layer of a cobalt(III) complex thereafter placed in contact with the first layer, and preferably heated, causes a reduction of the complex to take place.

Useful photoreductants include disulfides, anthrones, diazonium salts, and quinones. The quinones are particularly preferred. Preferably, a source of labile hydrogen atoms is also present either as a separately-added adjuvant such as is described in Paragraph II(C) of the last-named *Research Disclosure,* or as labile hydrogen atoms incorporated into the photoreductant in a form that increases the speed of the complex reduction, upon exposure. Incorporated hydrogen atom photoreductants are also described in the last-named *Research Disclosure.*

The quinones which are particularly useful as photoreductants include ortho- and para-benzoquinones and ortho- and para-naphthoquinones, phenanthrenequinones and anthraquinones. The quinones may be unsubstituted or incorporate any substituent or combination of substituents that do not interfere with the conversion of the quinone to the corresponding reducing agent. A variety of such substituents are known to the art and include, but are not limited to, primary, secondary and tertiary alkyl, alkenyl and alkynyl, aryl, alkoxy, aryloxy, alkoxyalkyl, acyloxyalkyl, aryloxyalkyl, aroyloxyalkyl, aryloxyalkoxy, alkylcarbonyl, carboxy, primary and secondary amino, aminoalkyl, amidoalkyl, anilino, piperindino, pyrrolidino, morpholino, nitro, halide and other similar substituents. Aryl substituents are preferably phenyl substituents. Alkyl, alkenyl and alkynyl substituents, whether present as sole substituents or present in combination with other atoms, preferably contain about 20 or fewer (preferably 6 or fewer) carbon atoms.

A binder is preferably included in said amine-generating composition. Any binder compatible with cobalt(III) complexes is useful, for example, the binders listed in the aforesaid Publication No. 12617 of *Research Disclosure,* especially paragraph I(D). Typical of such binders are acetates, cellulose compounds, vinyl polymers, polyacrylates and polyesters. In addition, useful binders are selected from those that maximize the maximum neutral densities produced during exposure and development. Highly preferred examples of such binders include certain polysulfonamides, for example, poly(ethylene-co-1,4-cyclohexylenedimethylene-1-methyl-2,4-benzenedisulfonamide), poly(ethylene-co-hexamethylene-1-methyl-2,4-benzenedisulfonamide), and poly(methacrylonitrile).

The most preferred photoreductants presently are the internal hydrogen source quinones; that is, quinones incorporating labile hydrogen atoms as described above. These quinones are more easily photoreduced than quinones which do not incorporate labile hydrogen atoms.

Further details and a list of various quinone photoreductants of the type described above are set forth in the aforesaid *Research Disclosure,* Volume 126, October, 1974, Publication No. 12617. Still others which are useful include 2-isopropoxy-3-chloro-1,4-naphthoquinone and 2-isopropoxy-1,4-anthraquinone.

Activating electromagnetic energy of wavelengths less than 300 nm, e.g., X-rays, is also useful as an exposure mode. In such a case, a photoreductant is not a necessary part of the amine-generating material and can be omitted.

Still other forms of activating energy are useful, such as energetic particle radiation, for example, electron-beam radiation.

The amine-responsive dye precursor can be any compound or composition that produces a dye in the presence of an amine. Preferred are those that are aromatic dialdehydes, such as 4-hydroxy, 4-benzyloyloxy-, 4-methacryloyloxy-, 4-t-butyl- and 4-bromo-1,2-dicarboxaldehyde; 5,6,7,8-tetrahydro-5,5,8,8-tetramethylnaphthalene-2,3-dicarboxaldehyde; and 2,3-naphthalenedicarboxaldehyde. Most preferred are aromatic dialdehydes, such as phthalaldehyde, that are also reducing agent precursors which, in the presence of amines, form a reducing agent for remaining cobalt(III) complexes. Thus phthaladehyde functions also as an amplifier. Further details of the phthalaldehyde mechanism are set forth in DoMinh et al, "Reactions of Phthalaldehyde with Ammonia and Amines," *J. Org. Chem.,* Vol. 42, Dec. 23, 1977, p. 4217, as well as in *Research Disclosure,* Vol. 194, No. 19423 (June 1980).

Optionally, other dye formers are incorporatable in the same layer or an adjacent layer, provided they are responsive to either the released amines or the cobalt(II) resulting from the reduction reaction. Examples are described in the aforesaid *Research Disclosure* Publication No. 12617.

Also optionally, a photoinhibitor of the type described in the aforesaid *Research Disclosure,* Pub. No. 18436 is useful in the composition, to provide positive-working image formation in response to light exposure. The photoinhibitor is selected to be one or more compounds which themselves have a sensitivity that responds to wavelengths longer than about 300 nm, or it is selected to comprise a compound whose sensitivity responds only to wavelengths shorter than about 300 nm, and a spectral sensitizer which increases the native sensitivity to beyond 300 nm.

Any photoinhibitor having the desired property of inhibiting the release of amines in response to an exposure to activating radiation, is useful. Where the mixture of dye-forming or imaging composition and photoinhibitor is intended to be used as a dried coating composition, it is preferable that the photoinhibitor be capable of being coated without extensive volatilization.

Examples and further details of the photoinhibitors are described in said *Research Disclosure,* Pub. No.

18436, the content of which is incorporated herein by reference.

When a photoinhibitor is included, preferably the dye- or image-former operates, when thermally activated, to produce an opaque density, rather than an absence of density.

An imaging element is prepared by coating or otherwise forming one or more layers of the aforedescribed composition from solution on a support. The simplest form of the element comprises a support and a single layer on the support. Alternatively, the amine-generating composition and the amine-responsive dye precursor are divided into a plurality of layers. Such plurality of layers still form an integral element, or alternatively the outermost layer is disposed in reactable association subsequently, such as after exposure. Examples and details are described in the aforesaid *Research Disclosure* No. 18436.

As noted above, the support is selected to have dimensional changes, when heated in an uncoated state for about 5 sec. at a temperature of about 125° C., that do not exceed about ±0.1% in width and length. Any such support is useful, and highly preferred are polymeric film supports such as poly(ethylene terephthalate) supports that have been heat-treated in the manner described in the aforesaid U.K. Pat. No. 1,00,361 or U.S. Pat. No. 2,779,684. Even with such treatment, care should be taken to select a portion of the web having the desired dimensional stability. Usually such portions occupy the middle 9/10's of the web measured widthwise.

The solvent for coating the amine-generating composition and amine-responsive dye precursor onto the support is selected from suitable conventional solvents, for example, lower alkanols such as methanol, ethanol, isopropanol, t-butanol and the like; ketones such as methylethyl ketone, acetone and the like; water; ethers such as tetrahydrofuran; dimethyl sulfoxide; and the like; as well as mixtures of the same.

The proportions of the non-binder reactants forming the radiation-sensitive layer(s) vary, depending upon which materials are being used. A preferred range of coating coverage of amine-generating materials such as a cobalt(III) complex is between about 5 and about 50 mg/dm$^2$, of photoreductant is between about 0.4 and about 320 mg/dm$^2$, and of aromatic dialdehyde is between about 0.25 and about 5 g/dm$^2$.

In certain instances, an overcoat layer provides improved handling characteristics and helps to retain otherwise volatile components. Useful examples include gelatin overcoats crosslinked with an agent, such as a 5-weight percent aqueous solution of hexamethoxymethyl melamine, with or without a further overcoat of a water-soluble cellulose acetate layer, and various acrylamide-containing copolymers such as poly(acrylamide-co-N-vinyl-2-pyrrolidone-co-2-acetoacetoxyethyl methacrylate) (50:40:05 wt percent), as are more fully described for example in commonly-owned U.S. Application Ser. No. 078,865, filed on Sept. 26, 1979, by Adin et al, entitled "Imaging Elements," the details of which are expressly incorporated herein by reference.

In accord with one aspect of the invention, it has been found that the essential property of dimensional stability, wherein no greater than ±0.03% changes occur in width or length when heated, is achievable by preheating the fully coated and dried imaging element prepared as described above, prior to exposing the imaging element to activating radiation. Preferably the pre-heating occurs with the imaging element in a relaxed state, at a temperature between about 100° C. and about 140° C. Unless otherwise stated, all pre-heating temperatures refer to the temperature of the imaging element. As used herein, "relaxed" means with only that tension necessary to transport the element through or otherwise mount the imaging element relative to the heating means for this process. "Pre-heating" refers to a heating step that occurs before exposure and development by heating.

The actual heating temperatures and time will vary, depending upon (a) the dimensional change characteristics of the support, and (b) the nature of the radiation-sensitive layer(s) on the support. If the selected support when uncoated shows dimensional changes of no greater than about 0.01% upon heating, the pre-heating can be at a temperature as low as 100° C. for about two to five seconds. However, if the support and/or the radiation-sensitive layer(s) show greater inherent dimensional changes upon thermal processing, the preheating is carried out for longer times, e.g., up to about 20 sec., and/or at higher temperatures up to about 140° C. Preheating conditions more severe than this are not advisable, partly due to their adverse photographic effects.

For most imaging elements of this invention, the most preferred pre-heating conditions are those in which the imaging element is heated for at least five seconds at a temperature of at least 120° C. These conditions permit the use of poly(ethylene terephthalate) supports that have dimensional changes, when uncoated, that are just less than ±0.1%.

Conventional heating means of various types are useful to provide the pre-heating treatment. For example, the coated imaging element is pre-heated batchwise in an oven, is automatically transported via conveyor means through an oven, or is heated by a rotating heated drum on which it is mounted. Examples of apparatus for the last-named means include the drums described in U.S. Pat. No. 4,112,280. Examples of ovens through which imaging elements are continuously conveyed, such as by automatic transport means, include those described in *Research Disclosure,* Vol. 162, Pub. No. 16239, Oct. 1977.

Following the pre-heating treatment, the imaging element is ready for exposure and dye development. Conventional exposure devices are useful for exposing the imaging element to activating radiation, for example an exposure device available from IBM under the trademark "Microcopier IID." Development of the dye is obtained by thermal processing at a variety of times and temperatures. A preferred processing condition is 5 sec. at 125° C., the conditions at which the imaging element is tested for this invention to determine its dimensional changes.

EXAMPLES

The following examples further illustrate the scope of the invention.

EXAMPLES 1-3

A gel-subbed 100-micron thick poly(ethylene terephthalate) support was taken as a 35 mm wide strip from a heat-relaxed web, the portion selected having dimensional changes, when thermally processed uncoated, as noted in Table I, Control A. This was divided into three portions for Examples 1-3. One side was given the following successive coats:

| | |
|---|---|
| First Coat: | |
| Phthalaldehyde | 25.1 mg/dm$^2$ |
| $[(NH_3)_6CO]$ $(CF_3CO_2)_3$ | 12.5 mg/dm$^2$ |
| Dimethyl polyoxyalkylene ether copolymer surfactant obtained under the trademark SF-1066 | 3.8 mg/dm$^2$ |
| 3-Chloro-2-isopropoxy-1,4-naphthoquinone | 0.4 mg/dm$^2$ |
| Poly(ethylene-co-1,4-cyclohexylenedimethylene-1-methyl-2,4-benzenedisulfonamide) | 75.6 mg/dm$^2$ |
| Second Coat: (adjusted to pH 3.5) | |
| Type IV gelatin | 19.5 mg/dm$^2$ |
| Nonylphenoxy polyglycidol surfactant available from Olin Corp. under the trademark "10G" | 0.65 mg/dm$^2$ |
| Glycerol | 1.0 mg/dm hu 2 |
| Poly(methylmethacrylate) beads | 1.0 mg/dm$^2$ |
| (hexamethoxymethyl) melamine available from American Cyanimid Co. as "Cymel 301" | 2.1 mg/dm$^2$ |

The second coat was also applied to the opposite face of the subbed support. The test examples were all dried. Pre-heating of Example 1 was accomplished using the apparatus of FIG. 2 of said U.S. Pat. No. 4,112,280, under the conditions noted in Table I. Pre-heating of Examples 2 and 3 was accomplished using the oven described in said *Research Disclosure* No. 16239 under the conditions noted in Table I. Dimensional changes were measured after heating for 5 sec. at 125° C. In all cases, percent measurements had an experimental error of ±0.004%.

TABLE I

| Example | Nature of Example | Pre-Heat Conditions Time(sec) | Pre-Heat Conditions Temp(°C.) | % Dimensional Change Length | % Dimensional Change Width |
|---|---|---|---|---|---|
| Control A | Uncoated support | none | | −0.01 | 0.02 |
| Control B | Coated element | none | | −0.05 | 0.03 |
| 1 | Coated element | 5 | 100 | −0.01 | 0.00 |
| 2 | Coated element | 15 | 100 | 0.00 | 0.03 |
| 3 | Coated element | 5 | 110 | 0.00 | 0.02 |

As indicated in Table I, without the pre-heating in accordance with the invention, the dimensional change in length for Control B was an unacceptable 0.05%. As shown in Examples 1-3, pre-heating reduced the changes to ±0.03% or less.

EXAMPLES 4-6

The procedure of Example 1 was repeated, except that the support was selected so as to provide more intrinsic dimensional changes itself, as noted in Table II, Control C. For this reason, the pre-heating conditions were more severe, as noted in Table II. In Example 4 the material was pre-heated on the drum in a manner similar to the pre-heating of Example 1, whereas in Examples 5 and 6 pre-heating took place in an oven similarly to Examples 2-3.

TABLE II

| Example | Nature of Example | Pre-Heat Conditions Time(sec) | Pre-Heat Conditions Temp(°C.) | % Dimensional Change Length | % Dimensional Change Width |
|---|---|---|---|---|---|
| Control C | Uncoated Support | none | | −0.08 | 0.04 |
| Control D | Coated element | none | | −0.09 | 0.04 |
| 4 | Coated element | 5 | 120 | −0.01 | −0.01 |
| 5 | Coated element | 10 | 120 | −0.02 | 0.01 |
| 6 | Coated element | 5 | 130 | −0.02 | 0.02 |

EXAMPLE 7—PRE-HEATING AT 140° C.

The procedure of Example 1 was repeated, except as follows: The poly(ethylene terephthalate) support had, uncoated, the following dimensional changes when thermally processed at 125° C. for 5 seconds: ±0.02% in width and −0.01% in length. The coatings applied were:

| | mg/dm$^2$ |
|---|---|
| 1st Coating | 3.7 |
| SF-1066 Surfactant | |
| Poly(ethylene-co-1,4-cyclohexylenedimethylene-1-methyl(2,4-benzenedisulfonamide) | 73.1 |
| Phthalaldehyde | 24.2 |
| Hexa-ammine cobalt(III) trifluoroacetate | 12.1 |
| 3-chloro-1,4-naphthoquinone | 0.34 |
| 2nd Coating | |
| Deionized Gelatin | 19.5 |
| Glycerol | 1.0 |
| Methyl methacrylate beads | 1.0 |
| Cymel 301 | 2.1 |

As before, the second coating was also applied to the opposite side of the subbed support. Table III sets forth the dimensional changes following the pre-heating under the conditions noted in the Table. (The pre-heating was done after equilibrating the samples at 30% RH and 24° C.) Unlike the previous examples, the dimensional changes reported in Table III were measured as a result of thermal processing for 10 seconds, rather than 5, at 125° C.

TABLE III

| Example | Nature of Example | Pre-Heat Conditions Time(sec) | Pre-Heat Conditions Temp(°C.) | % Dimensional Change Length | % Dimensional Change Width |
|---|---|---|---|---|---|
| Control E | Coated element | none | | −0.042 | +0.016 |
| 7 | Coated element | 5 | 140 | −0.023 | −0.02 |

Here, the thermal processing is more severe than the test of the invention. Therefore, it is expected that, had testing been done for only 5 seconds, the percent dimensional changes of Example 7 after the pre-heating of the invention would be no more than the −0.023% and −0.02% noted.

COMPARATIVE EXAMPLES

The process described in Example 1 of U.S. Pat. No. 3,939,000 was carried out using radiographic film sold by Eastman Kodak Company under the trademark "4519 X-Omat L." Such film is considered as being comparable to that used in Example 1 of said U.S. Pat.

No. 3,939,000. This film comprises a 175 micron-thick, subbed poly(ethylene terephthalate) support, not specifically relaxed, coated on both sides with a silver halide composition containing 80 mg of Ag per $dm^2$ per side, and on each of those two coatings, an anti-abrasion layer comprising 8.9 mg of gelatin/$dm^2$. Portions of the film were tested for dimensional changes when thermally processed at 125° C. for 5 sec., and other portions were pre-heated for 7 sec. at 107° C. in a forced hot-air oven as described in the U.S. Pat. No. 3,939,000, and then measured for dimensional change. Table IV set forth the results, wherein C.E. No. 1 is Control F pre-heated as noted, C.E. No. 2 is Control G, and C.E. No. 3 is Control H.

TABLE IV

| Example | Nature of Example | Pre-Heat Conditions Time(sec) | Pre-Heat Conditions Temp. (°C.) | Average* % Dimensional Change Length | Average* % Dimensional Change Width |
|---|---|---|---|---|---|
| Control F | Coated element | none | | −0.209 | 0.023 |
| Control G | Coated element | none | | −0.020 | 0.027 |
| Control H | Coated element | none | | −0.190 | 0.033 |
| Comparative Example 1 | Coated element | 7 | 107 | −0.027 | 0.081 |
| Comparative Example 2 | Coated element | 7 | 107 | −0.110 | 0.068 |
| Comparative Example 3 | Coated element | 7 | 107 | −0.111 | 0.069 |

*Average of two samples.

The importance of this test was that, after 7 sec. at 107° C., the dimensional changes during the prescribed thermal processing were still much greater than ±0.03%. In the case of Control G, the changes were worsened by the pre-heat treatment. In contrast, such pre-heating conditions have been shown to be useful in the practice of the invention, as demonstrated by Examples 1 and 3 above.

The invention has been described in detail with particular reference to preferred embodiments thereof, but it will be understood that variations and modifications can be effected within the spirit and scope of the invention.

What is claimed is:

1. A thermally processable photographic imaging element comprising a polymeric film support having dimensional changes that are no greater than ±0.1% in width and length when heated in an uncoated state for about 5 seconds at a temperature of about 125° C., and on the support, at least one radiation-sensitive layer comprising a radiation-responsive, amine-generating composition that includes a reducible cobalt(III) complex containing releasable amine ligands, and an amine-responsive dye precursor, said element having as an essential property, an overall thermal-reaction hysteresis that will provide a dimensional change of no greater than ±0.03% in width or length when processed by heating for about 5 seconds at a temperature of about 125° C.

2. A thermally processable photographic imaging element comprising a polymeric film support having dimensional changes that are no greater than ±0.1% in width and length when heated in an uncoated state for about 5 seconds at a temperature of about 125° C., and on the support, at least one radiation-sensitive layer comprising a radiation-responsive, amine-generating composition that includes a reducible cobalt(III) complex containing releasable amine ligands, and an amine-responsive dye precursor, said element having as an essential property, an overall thermal-reaction hysteresis that provides a dimensional change of no greater than ±0.03% in width or length when processed by heating for about 5 seconds at a temperature of about 125° C., said hysteresis being the result of heating said element, prior to development of an image, to a temperature of between about 100° C. and about 140° C. for a time of between about 2 and about 20 seconds.

3. An element as defined in claim 1 or 2, wherein said amine-generating composition further includes a photoreductant responsive to electromagnetic energy of longer than 300 nm wavelengths to form a reducing agent for said complex.

4. An element as defined in claim 1 or 2, wherein said dye precursor is o-phthalaldehyde.

5. An element as defined in claim 1 or 2, wherein said support comprises poly(ethylene terephthalate).

* * * * *

UNITED STATES PATENT AND TRADEMARK OFFICE

CERTIFICATE OF CORRECTION

PATENT NO. 4,308,342

DATED December 29, 1981

INVENTOR(S) Raymond F. Limoges, Anthony A. Scribani and Robert J. Wilson

It is certified that error appears in the above-identified patent and that said Letters Patent are hereby corrected as shown below Col. 7, line 47, "0.25", should read --0.025--.

Signed and Sealed this

Twelfth Day of April 1983

[SEAL]

Attest:

GERALD J. MOSSINGHOFF

Attesting Officer

Commissioner of Patents and Trademarks